US009638130B2

(12) United States Patent
Shimizu

(10) Patent No.: US 9,638,130 B2
(45) Date of Patent: May 2, 2017

(54) APPARATUS AND METHOD FOR CONTROLLING INTERNAL COMBUSTION ENGINE

(71) Applicant: HITACHI AUTOMOTIVE SYSTEMS, LTD., Hitachinaka-shi, Ibaraki (JP)

(72) Inventor: Hirokazu Shimizu, Isesaki (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 140 days.

(21) Appl. No.: 13/797,314

(22) Filed: Mar. 12, 2013

(65) Prior Publication Data

US 2013/0245914 A1 Sep. 19, 2013

(30) Foreign Application Priority Data

Mar. 19, 2012 (JP) ..... 2012-061368

(51) Int. Cl.
*F02D 45/00* (2006.01)
*F02D 41/04* (2006.01)
(Continued)

(52) U.S. Cl.
CPC ..... *F02D 45/00* (2013.01); *F02D 41/042* (2013.01); *F02D 41/009* (2013.01);
(Continued)

(58) Field of Classification Search
CPC ..... F02D 41/02; F02D 41/04; F02D 41/06; F02D 41/009; F02D 41/042; F02D 45/00;
(Continued)

(56) References Cited

U.S. PATENT DOCUMENTS 5,794,592 A * 8/1998 Fukui ..... F02D 41/009 123/406.62
6,492,804 B2 12/2002 Tsuge et al.
(Continued)

FOREIGN PATENT DOCUMENTS

JP 11-064363 A 3/1999
JP 2001-165951 A 6/2001
(Continued)

*Primary Examiner* — Hung Q Nguyen
*Assistant Examiner* — Brian P Monahon
(74) *Attorney, Agent, or Firm* — Foley & Lardner LLP

(57) ABSTRACT

An apparatus and a method for controlling an internal combustion engine, detects a rotating direction of an output shaft of the internal combustion engine. The internal combustion engine includes a crank angle sensor for outputting a pulse signal in accordance with rotation of a crankshaft. The crank angle sensor outputs at the time of reverse rotation of the crankshaft a pulse signal POS having a wider pulse width than that at the time of forward rotation. A control unit receiving pulse signal POS calculates a difference between a present value and a previous value of a pulse width of pulse signal POS and detects switching of a rotating direction of the crankshaft based on a magnitude of this difference. Thus, it is possible to suppress lowering of detection accuracy of a rotating direction of the crankshaft under the influence of variation of measurement values of the pulse width.

20 Claims, 6 Drawing Sheets

(51) Int. Cl.
*F02N 11/08* (2006.01)
*F02D 41/00* (2006.01)

(52) U.S. Cl.
CPC .. *F02D 2041/0095* (2013.01); *F02D 2250/06* (2013.01); *F02N 11/0818* (2013.01)

(58) Field of Classification Search
CPC ..... F02D 2041/0095; F02D 2250/06; F02N 11/0818
USPC ..... 73/114.25, 114.26; 123/185.13, 198 D, 123/406.18, 494, 406.58, 631; 701/101, 701/102, 107, 110, 113, 114, 115
See application file for complete search history.

(56) References Cited

U.S. PATENT DOCUMENTS 6,559,634 B2 * 5/2003 Yamada ..... B60T 8/171 324/161
6,732,713 B1 * 5/2004 Kanazawa ..... F02D 41/009 123/406.6
2001/0002791 A1 6/2001 Tsuge et al.
2004/0159297 A1 * 8/2004 Kataoka ..... F02N 11/0814 123/179.4
2007/0245817 A1 * 10/2007 Matsushima ..... F02D 41/009 73/114.26
2008/0010037 A1 * 1/2008 Hashizume ..... F02D 41/009 702/151
2008/0092841 A1 * 4/2008 Takahashi ..... F02D 41/009 123/179.16
2008/0115753 A1 * 5/2008 Noguchi ..... F02N 11/105 123/179.3
2010/0241302 A1 * 9/2010 Shimizu ..... F01L 1/34403 701/31.4
2011/0144890 A1 * 6/2011 Keiner ..... F02D 41/02 701/103
2012/0303251 A1 * 11/2012 Shimizu ..... F02D 13/0238 701/113

FOREIGN PATENT DOCUMENTS

JP 2005-233622 A 9/2005
JP 2010-242742 A 10/2010
WO WO 2011/078129 A1 6/2011

* cited by examiner

APPARATUS AND METHOD FOR CONTROLLING INTERNAL COMBUSTION ENGINE

BACKGROUND OF THE INVENTION

1. Field of the Invention

The present invention relates to an apparatus and a method for controlling an internal combustion engine, and relates to determining a rotating direction of an output shaft of an internal combustion engine.

2. Description of Related Art

Japanese Laid-open (Kokai) Patent Application Publication No. 2010-242742 discloses a rotation detecting apparatus provided with a rotating sensor outputting a pulse signal having different pulse width or amplitude depending on whether an output shaft of an internal combustion engine is rotated forward or in reverse and detecting a rotating direction of the output shaft based on comparison between the pulse width or amplitude of the pulse signal, and a threshold value.

However, there is a case in which detection accuracy of the rotating direction is reduced when an environmental condition such as temperature is changed, causing a characteristic of the rotating sensor to be changed.

SUMMARY OF THE INVENTION

An object of the present invention is to provide an apparatus and a method for controlling an internal combustion engine allowing for limitation of the reduction in detection accuracy of a rotating direction along with a change in environment such as in temperature.

To achieve the above object, an apparatus for controlling an internal combustion engine according to the present invention detects a rotating direction of an output shaft of the internal combustion engine based on a change in waveform of a pulse signal output by a rotating sensor.

Also, a method of controlling an internal combustion engine according to the present invention measures waveform of a pulse signal output by a rotating sensor and detects a rotating direction of an output shaft of the internal combustion engine based on a change in a measurement value of the waveform.

The other objects and features of this invention will be understood from the following description with reference to the accompanying drawing.

DESCRIPTION OF THE PREFERRED EMBODIMENTS

Figure 1:
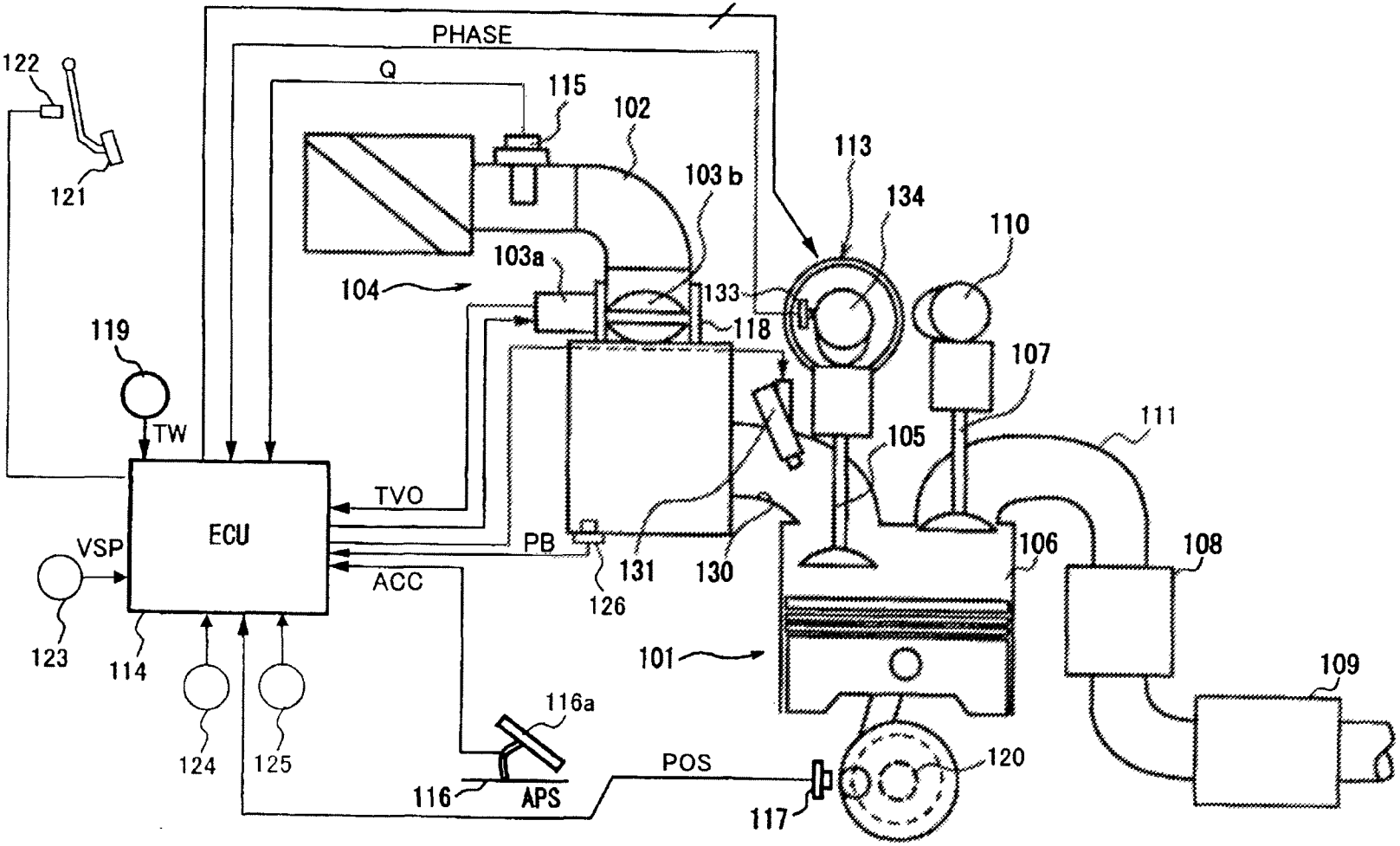
FIG. 1 is a system configuration view illustrating an internal combustion engine according to an embodiment of the present invention.

FIG. 1 is a system view illustrating an example of an internal combustion engine for a vehicle to which a control apparatus and a control method according to the present invention is applied. An internal combustion engine 101 is an in-line four-cylinder engine in the present embodiment.

Internal combustion engine 101 is provided, in an intake pipe 102 thereof, with an electronic control throttle 104. Electronic control throttle 104 includes a throttle motor 103*a* and a throttle valve 103*b*.

Internal combustion engine 101 takes air into a combustion chamber 106 of each cylinder via electronic control throttle 104 and an intake valves 105.

An intake port 130 of each cylinder is provided with a fuel injection valve 131. Fuel injection valve 131 opens by an injection pulse signal from an ECU (engine control unit) 114 as a control apparatus and injects fuel.

Fuel in combustion chamber 106 is combusted by spark ignition by a spark plug (not shown).

Combusted gas in combustion chamber 106 flows out to an exhaust pipe 111 via exhaust valves 107.

A front catalytic converter 108 and a rear catalytic converter 109 provided at exhaust pipe 111 clean exhaust gas flowing in exhaust pipe 111.

An intake camshaft 134 and an exhaust camshaft 110 integrally include cams and open intake valves 105 and exhaust valves 107 by the cams.

A variable valve timing mechanism 113 provided at intake camshaft 134 is a mechanism of continuously changing valve timing of intake valves 105 by continuously changing rotational phase of intake camshaft 134 against a crankshaft 120 as an output shaft of internal combustion engine 101.

ECU 114 has built therein a microcomputer, performs calculation in accordance with a program previously stored in a memory such as a ROM, and outputs operation signals to electronic control throttle 104, variable valve timing mechanism 113, fuel injection valve 131, and the like.

ECU 114 receives detection signals from various sensors.

Various sensors provided are an accelerator opening sensor (APS) 116 detecting a stroke amount of an accelerator pedal 116 a, that is, accelerator opening ACC, an airflow sensor 115 detecting an intake air amount Q of internal combustion engine 101, a crank angle sensor 117 outputting a pulsed rotation signal POS in accordance with rotation of crankshaft 120, a throttle sensor 118 detecting opening TVO of throttle valve 103 *b*, a water temperature sensor 119 detecting a temperature TW of cooling water of internal combustion engine 101, a cam sensor 133 outputting a pulsed cam signal PHASE in accordance with rotation of intake camshaft 134, a brake switch 122 turned on at the time of braking when a brake pedal 121 is pressed, a vehicle speed sensor 123 detecting traveling speed VSP of the vehicle, an intake air pressure sensor 126 detecting intake air pressure PB, and the like.

ECU 114 also receives a signal of an ignition switch 124 and a signal of a starter switch 125 as main switches for operation and stop of internal combustion engine 101.

Figure 2A:
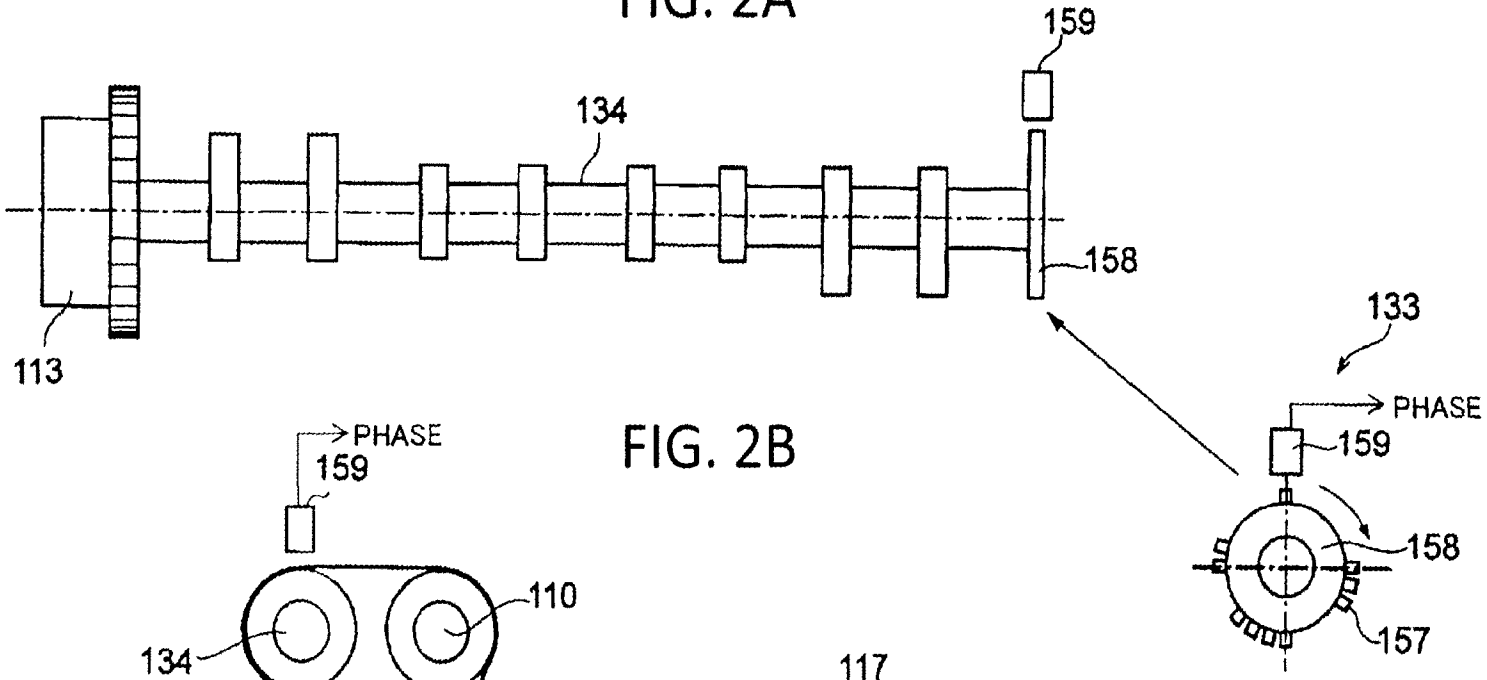
FIGS. 2A and 2B are views illustrating a structure of a crank angle sensor and a structure of a cam sensor according to the embodiment of the present invention.
Figure 2B:
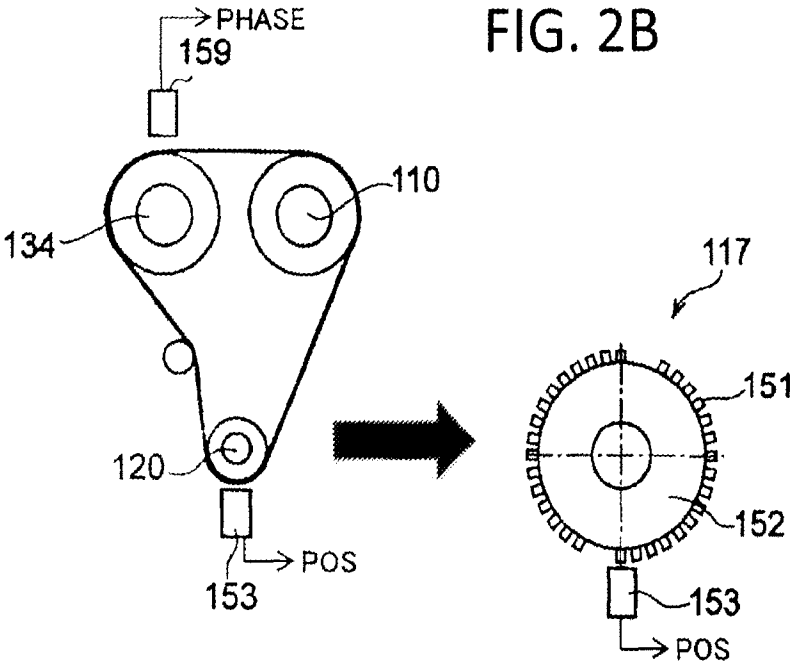

FIGS. 2A and 2B illustrate a structure of crank angle sensor 117 as a rotating sensor of the output shaft of internal combustion engine 101 and a structure of cam sensor 133.

Crank angle sensor 117 is configured to include a signal plate 152 axially supported by crankshaft 120 as the output shaft of internal combustion engine 101 and including therearound projecting portions 151 as detected portions, and a rotation detecting device 153 fixed on a side of internal combustion engine 101, detecting projecting portion 151 of signal plate 152, and outputting pulsed rotation signal POS.

Rotation detecting device 153 integrally includes a pickup detecting projecting portion 151 and generating the pulse signal and various processing circuits such as a waveform generating circuit and a selecting circuit.

Rotation signal POS output by rotation detecting device 153 is a pulse signal maintaining a low level in a case in which projecting portion 151 is not detected and changed to a high level for a predetermined period when projecting portion 151 is detected. Alternatively, rotation signal POS can be a pulse signal maintaining a high level in a case in which projecting portion 151 is not detected and changed to a low level for a predetermined period when projecting portion 151 is detected.

Projecting portions 151 of signal plate 152 are equally spaced, e.g., at 10-degree crank angle pitches, and two parts each lacking two consecutive projecting portions 151 are provided at diametrically opposite positions of a rotation center of crankshaft 120.

It is to be noted that the number of lacking projecting portions 151 can be one or three or more.

Figure 3:
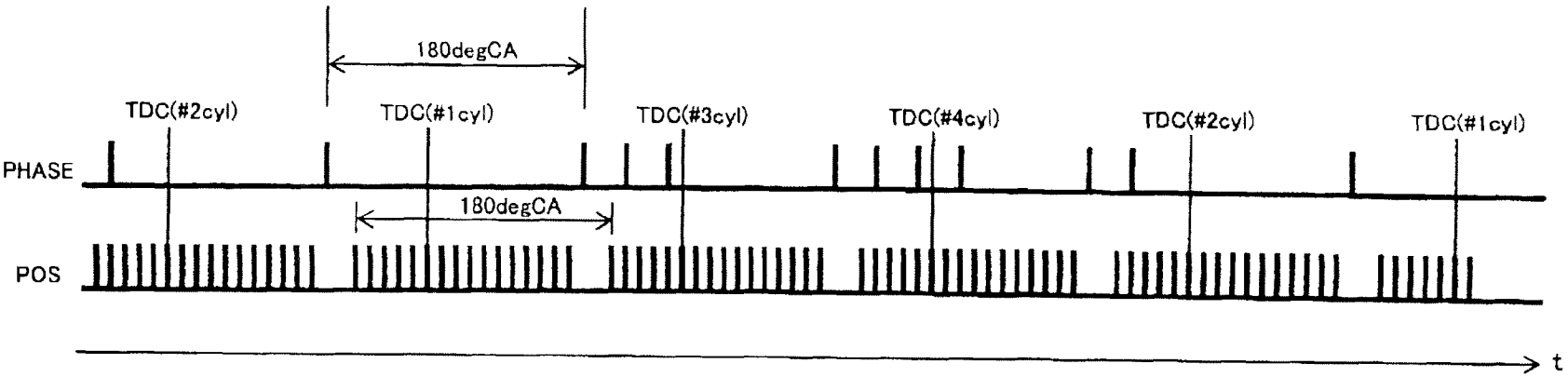
FIG. 3. is a timing chart illustrating output characteristics of the crank angle sensor and the cam sensor according to the embodiment of the present invention.

Thus, as illustrated in FIG. 3, pulsed rotation signals POS output from crank angle sensor 117 are changed to high levels 16 times in a row per 10-degree crank angle, thereafter hold low levels at 30 degrees, and are changed to high levels 16 times in a row again.

Rotation signals POS illustrated in FIG. 3 are pulse signals maintaining low levels in a case in which projecting portions 151 are not detected and changed to high levels for a predetermined period when projecting portions 151 are detected.

First rotation signal POS after a 30-degree pulse lacking period is output per 180-degree crank angle, and this 180-degree crank angle corresponds to a stroke phase difference among cylinders in in-line four cylinder engine 101, that is, an ignition interval.

It is to be noted that a reference crank angle sensor which makes rotation signals POS to output at regular intervals without lacks, and outputting a pulsed reference crank angle signal at a reference crank angle position can be provided separately from crank angle sensor 117.

As illustrated in FIG. 2A, cam sensor 133 is configured to include a signal plate 158 axially supported by an edge portion of intake camshaft 134 and including therearound projecting portions 157 as detected portions, and a rotation detecting device 159 fixed on a side of internal combustion engine 101, detecting projecting portion 157, and outputting pulsed cam signal PHASE.

Rotation detecting device 159 integrally includes a pickup detecting projecting portion 157 and generating the pulse signal, and various processing circuits such as a waveform shaping circuit.

One, three, four, and two projecting portions 157 of signal plate 158 are provided at four locations per 90-degree cam angle, and at each location at which a plurality of projecting portions 157 are provided consecutively, a pitch of projecting portions 157 is set to a 30-degree crank angle or a 15-degree cam angle.

Cam signals PHASE as pulse signals to be output from cam sensor 133 maintaining low levels in a case in which projecting portions 157 are not detected and are changed to high levels for a predetermined period when projecting portions 157 are detected, and a single, three consecutive, four consecutive, and two consecutive cam signals PHASE are changed to high levels per 90-degree cam angle or 180-degree crank angle.

It is to be noted that cam signal PHASE can be a pulse signal maintaining a high level in a case in which projecting portion 157 is not detected and changed to a low level for a predetermined period when projecting portion 157 is detected.

Among cam signals PHASE, a single cam signal PHASE and each first signal of consecutively output cam signals PHASE are output per 180-degree crank angle.

Here, the consecutive output number of cam signals PHASE represents a number of a cylinder of which piston is in a specific position. In four-cylinder engine 101, the output of cam signals PHASE illustrates that a stroke phase difference among the cylinders is a 180-degree crank angle and that ignition is performed in an order of the first cylinder, the third cylinder, the fourth cylinder, and the second cylinder.

That is, when the consecutive output number of cam signals PHASE is 1, this means the first cylinder's piston is in a specific position. When the consecutive output number of cam signals PHASE is 3, this means the third cylinder's piston is in a specific position. When the consecutive output number of cam signals PHASE is 4, this means the fourth cylinder's piston is in a specific position. When the consecutive output number of cam signals PHASE is 2, this means the second cylinder's piston is in a specific position.

ECU 114 counts the consecutive output number of cam signals PHASE to determine a cylinder of which piston is to be subsequently located at a reference position such as a top dead center TDC, specifies a cylinder that should perform fuel injection and ignition based on a result of such determination, and sets a cylinder to which an injection pulse signal and an ignition signal are to be output.

To be more specific, ECU 114 determines a lacking position of rotation signals POS from cyclic changes of rotation signals POS or the like, specifies a period in which a generating number of cam signals PHASE is to be counted with reference to this lacking position, and detects a cylinder of which piston will be located at the top dead center subsequently based on the generating number of cam signals PHASE in this counting period.

Here, phase between rotation signals POS and cam signals PHASE changes as rotational phase of intake camshaft 134 against crankshaft 120 is changed by variable valve timing mechanism 113.

ECU 114 detects a reference crank angle position REF with reference to a lacking portion of rotation signals POS and detects an angle from this reference crank angle position REF to a position at which cam signal PHASE is output as a value representing rotational phase of intake camshaft 134 by variable valve timing mechanism 113.

ECU 114 then calculates targeted rotational phase based on engine operating states such as engine load and engine rotating speed in control of variable valve timing mechanism 113 and calculates and outputs an operation signal of variable valve timing mechanism 113, e.g., by proportion, integration, and differential operations based on a deviation between the actual rotational phase and the targeted rotational phase.

Rotation signal POS is used not only for detection of rotational phase of intake camshaft 134 as described above but also for calculation of engine rotating speed NE, and in addition, detection of a rotating position of crankshaft 120.

That is, rotation signal POS also functions as a measurement signal for a rotating position of crankshaft 120, and by counting a generating number of rotation signals POS from a lacking portion of rotation signals POS or reference crank angle position REF detected with reference to the lacking portion, a rotating position, that is, a rotating angle of crankshaft 120 can be detected.

For example, in a case in which internal combustion engine 101 is temporarily stopped by idle reduction control, by calculating an angle position of crankshaft 120 at the time of stop of internal combustion engine 101, fuel injection can be resumed early at the time of restart, and starting responsiveness can be enhanced.

ECU 114 detects the angle position of crankshaft 120 at the time of stop of internal combustion engine 101 based on rotation signals POS.

However, there is a case in which internal combustion engine 101 is rotated in a reverse direction due to compression pressure in the cylinder or the like immediately before stop of internal combustion engine 101, and when the generating number of rotation signals POS is counted at the time of reverse rotation similarly to the time of forward rotation, the angle position of crankshaft 120 at the time of stop of internal combustion engine 101 will be detected incorrectly.

To cope with this, crank angle sensor 117 is adapted to output rotation signal POS having a different pulse width depending on whether crankshaft 120 is rotated forward or in reverse so that a rotating direction of internal combustion engine 101 can be distinguished.

Figure 4:
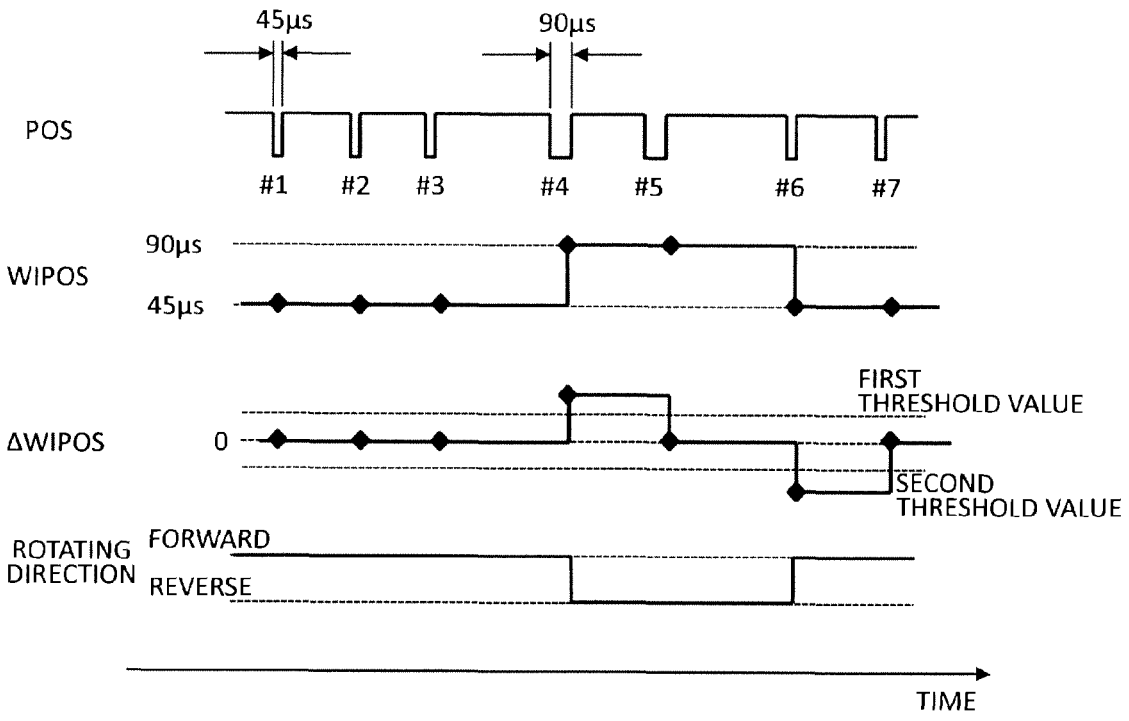
FIG. 4 is a timing chart illustrating correlation among a rotation signal POS, a pulse width, a change amount of the pulse width, and a rotating direction according to the embodiment of the present invention.

FIG. 4 illustrates a difference of a pulse width at the time of forward rotation and reverse rotation in a case in which an output characteristic of rotation signal POS is a characteristic in which rotation signal POS holds a high level when projecting portion 151 is not detected and temporarily becomes a low level when projecting portion 151 is detected.

In an example illustrated in FIG. 4, a pulse width at the time of forward rotation is 45 μs whereas a pulse width at the time of reverse rotation is 90 μs.

It is to be noted that, although a pulse width WIPOS at the time of forward rotation is set to 45 μs whereas pulse width WIPOS at the time of reverse rotation is set to 90 μs in the present embodiment, pulse width WIPOS is not limited to 45 μs or 90 μs as above. Also, pulse width WIPOS can be set to be wider at the time of forward rotation than at the time of reverse rotation.

Furthermore, a signal characteristic of rotation signal POS can be one in which rotation signal POS holds a low level when projecting portion 151 is not detected and temporarily becomes a high level when projecting portion 151 is detected, and a pulse width in a high level period can be different depending on whether rotation is forward or reverse.

As a method of generating a rotation signal having a different pulse width depending on a rotating direction of the rotating shaft, a method disclosed in Japanese Laid-open (Kokai) Patent Application Publication No. 2001-165951 is used, for example Specifically, in the rotation detecting device 153, two mutually phase-shifted signals are generated as detection pulse signals of projecting portions 151 of signal plate 152 and are compared with each other to determine whether rotation is forward or reverse, and either one of the two pulse signals generated as signals having different pulse widths WIPOS is selected based on a determination result of the rotating direction and is output as a final rotation signal.

ECU 114 measures pulse width WIPOS of rotation signal POS and determines whether crankshaft 120 as the output shaft of internal combustion engine 101 is rotated forward or in reverse based on a temporal change of measured pulse width WIPOS.

ECU 114 then detects in a forward rotation state of crankshaft 120 that crankshaft 120 is rotated in a forward direction at the time of output of rotation signal POS as much as a crank angle corresponding to a generating interval of rotation signals POS from the position at the time of output of previous rotation signal POS.

On the other hand, ECU 114 detects in a reverse rotation state of crankshaft 120 that crankshaft 120 is rotated in a reverse direction at the time of output of rotation signal POS as much as a crank angle corresponding to a generating interval of rotation signals POS from the position at the previous time.

As described above, by determining forward rotation and reverse rotation to detect a stop position of crankshaft 120, even in a case in which crankshaft 120 is rotated in reverse immediately before stop of internal combustion engine 101, a stop position of crankshaft 120, in other words, a piston position of each cylinder at the time of stop, can be determined accurately, and fuel injection and ignition can be started early at the time of restart.

For example, when crankshaft 120 is rotated in reverse immediately before stop of internal combustion engine 101, and a stop position of crankshaft 120 is unclear, a rotating position of crankshaft 120 is unclear until a lacking portion of rotation signals POS is detected, for example, at the time of restart, and start of fuel injection and ignition is delayed.

In the present embodiment, ECU 114 has an idle reduction function in which internal combustion engine 101 is automatically stopped when automatic stop conditions are satisfied in an idle operating state of internal combustion engine 101 and is automatically restarted when restart conditions are satisfied after automatic stop of internal combustion engine 101. By starting fuel injection and ignition early at the time of automatic restart of internal combustion engine 101, restarting performance of internal combustion engine 101 can be improved.

In the idle reduction control, fuel injection and ignition are stopped, and internal combustion engine 101 is stopped when all of the following conditions are satisfied: vehicle speed VSP is 0 km/h, engine rotating speed NE is predetermined rotating speed or less, accelerator opening ACC is fully closed, brake switch 122 is ON, and cooling water temperature TW is a predetermined temperature or higher.

The aforementioned predetermined rotating speed is a value for determining an idle rotating state and is set to be much higher than targeted idle rotating speed. Also, the aforementioned predetermined temperature is a value for determining completion of warming-up.

On the other hand, in a state of automatic stop of internal combustion engine 101, when brake switch 122 is switched to OFF, the accelerator pedal is pressed, a duration period of the automatic stop state is longer than a reference period, or reduction in battery voltage is detected, for example, internal combustion engine 101 is restarted.

Internal combustion engine 101 can be restarted with use of a starter motor, or rotation of internal combustion engine 101 can be started by fuel combustion in the combustion chamber without using the starter motor.

Figure 5:
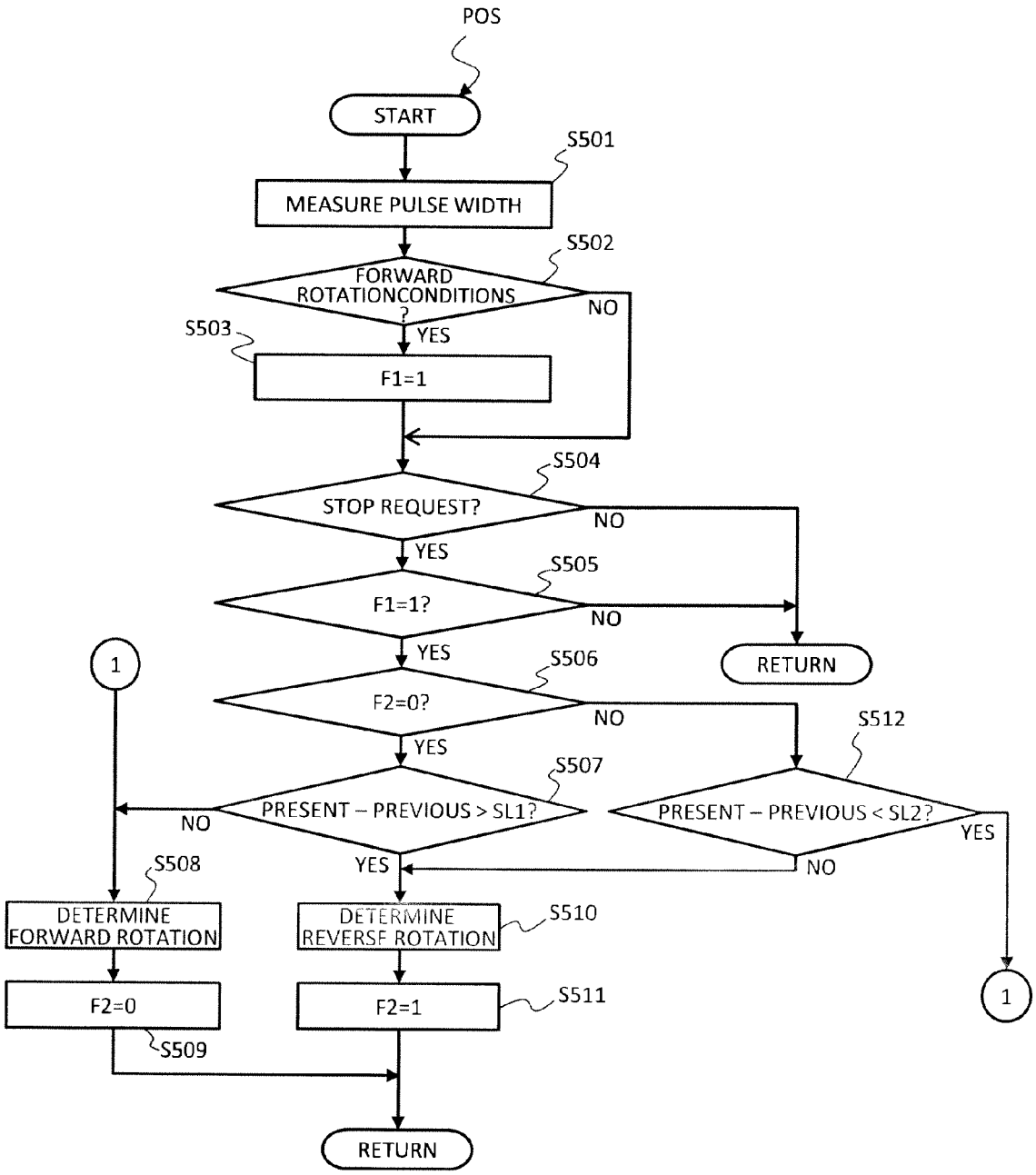
FIG. 5 is a flowchart illustrating determination processing of forward rotation and reverse rotation according to the embodiment of the present invention.

A flowchart in FIG. 5 illustrates a flow of determination processing of a rotating direction of crankshaft 120 by ECU 114.

A routine illustrated in the flowchart in FIG. 5 is executed in an interrupted manner every time there is generation of rotation signal POS. First, in step S501, pulse width WIPOS of rotation signal POS generated at present is measured.

Subsequently, in step S502, it is determined whether or not operating conditions of internal combustion engine 101 are conditions for forward rotation of crankshaft 120.

Specifically, it is determined that the operating conditions are conditions for forward rotation of crankshaft 120 in a case in which at least one of the following operating conditions (1) to (5) is satisfied.

When forward rotation is determined based on satisfaction of plural conditions of the following operating conditions (1) to (5), conditions for forward rotation can be determined more accurately.

(1) Engine rotating speed NE is predetermined rotating speed NES or more.
(2) A cylinder of which piston is determined to be located at a specified position is switched along a forward direction.
(3) Engine load TP is predetermined load TPS or higher.
(4) Starter switch 125 is in an ON state.
(5) Intake air pressure PB is in a state of increasing or decreasing from atmospheric pressure by a predetermined degree or more.

Operating condition (1) is determination of whether or not engine rotating speed NE, that is, rotating speed of crankshaft 120 is increased. Predetermined rotating speed NES is set to rotating speed that cannot be reached at the time of reverse rotation of crankshaft 120. For example, predetermined rotating speed NES is set to rotating speed of approximately 500 rpm.

That is, since a maximum value of engine rotating speed NE at the time of reverse rotation of internal combustion engine 101 is lower than a maximum value of engine rotating speed NE at the time of forward rotation of internal combustion engine 101, it can be assumed that crankshaft 120 is rotated forward in a case which engine rotating speed NE is one that exceeds the maximum value of engine rotating speed NE at the time of reverse rotation.

Operating condition (2) is determination of whether or not a cylinder of which piston is detected by ECU 114 to be located at a predetermined position is updated in an order corresponding to an order at the time of forward rotation of internal combustion engine 101.

As described above, since an ignition order of internal combustion engine 101 is an order of the first cylinder, the third cylinder, the fourth cylinder, and the second cylinder, it can be assumed that crankshaft 120 is rotated forward in a case in which a cylinder of which piston is determined to be located at a predetermined position is updated in this order.

Operating condition (3) is determination of whether or not internal combustion engine 101 is operated with engine load that is feasible in a forward rotation state of internal combustion engine 101. Thus, predetermined load TPS is set to engine load that is higher than low load in a state in which forward rotation is switched to reverse rotation immediately before stop of internal combustion engine 101. It can be assumed that rotation is forward in a case in which internal combustion engine 101 is operated with engine load TP that is predetermined load TPS or higher.

In other words, there is no possibility of operation of internal combustion engine 101 with engine load that exceeds predetermined load TPS in a case in which internal combustion engine 101 is rotated in reverse, and it can be assumed that internal combustion engine 101 is rotated forward in a case in which engine load is predetermined load TPS or higher.

As a state amount representing the engine load, a state amount representing an amount of air taken into internal combustion engine 101 such as intake air amount Q detected by airflow sensor 115 and a fuel injection amount calculated based on intake air amount Q can be used.

Here, the higher predetermined load TPS is set to be, the higher the determination accuracy of a forward rotation state becomes. However, even in a case in which predetermined load TPS is set to the extent that satisfaction of operating condition (3) is determined at the time of idle operation of internal combustion engine 101, for example, necessary and sufficient determination accuracy can be obtained.

Operating condition (4) is determination of whether or not internal combustion engine 101 is in a start operating state. In a case in which starter switch 125 is in an ON state, and internal combustion engine 101 is in a cranking state in which internal combustion engine 101 is rotated by the starter motor, crankshaft 120 is rotated in a rotating direction of the starter motor, that is, a forward rotating direction. Thus, it is assumed that crankshaft 120 is rotated forward in a case in which starter switch 125 is in an ON state, that is, in a case in which internal combustion engine 101 is in a start operating state.

Operating condition (5) is determination of a developing state of intake air pressure PB as pressure in intake pipe 102, that is, whether or not intake air pressure PB is changed from atmospheric pressure as much as a predetermined degree or more.

Reverse rotation of crankshaft 120 occurs immediately before stop of internal combustion engine 101, and intake air pressure PB immediately before the stop is around atmospheric pressure. In other words, in a case in which intake air pressure PB is changed from atmospheric pressure as much as a predetermined degree or more, it can be determined that internal combustion engine 101 is in a forward rotating state, and whether or not intake air pressure PB is changed from atmospheric pressure as much as a predetermined degree or more can be determined by comparison between intake air pressure PB and predetermined pressure PBS.

As described above, since intake air pressure PB is around atmospheric pressure at the time of reverse rotation, intake air pressure PB is set to predetermined pressure PBS. Intake air pressure PB is apart from atmospheric pressure as much as a predetermined degree or more, and cannot be reached at the time of reverse rotation of crankshaft 120, and in a case in which intake air pressure PB is further apart from atmospheric pressure than predetermined pressure PBS is, it is assumed that rotation is forward.

Here, in a case in which internal combustion engine 101 is a naturally-aspirated engine, intake air pressure PB is around atmospheric pressure in a full open operating state. Thus, predetermined pressure PBS is set to negative pressure. In a case in which intake air pressure PB is further negative than predetermined pressure PBS, that is, in a case in which internal combustion engine 101 is operated with low load having high intake negative pressure, it is assumed that internal combustion engine 101 is rotated forward.

Also, in a case in which internal combustion engine 101 includes a supercharger, intake air pressure PB is higher than atmospheric pressure by supercharging. Thus, predetermined pressure PBS is set to positive pressure. In a state of increased engine load in which intake air pressure PB is further positive than predetermined pressure PBS, it can be assumed that internal combustion engine 101 is rotated forward.

In a case in which internal combustion engine 101 is a naturally aspirated engine, intake air pressure PB gets closer to atmospheric pressure from negative pressure by an increase of engine load, and intake air pressure PB is around atmospheric pressure in a reverse rotating state as well, as described above. Thus, in a case in which determination of engine load is carried out based on intake air pressure PB, it can be assumed that internal combustion engine 101 is rotated forward in a case of a negative pressure generating state.

On the other hand, in a case in which internal combustion engine 101 includes a supercharger, intake air pressure PB becomes positive pressure that is higher than atmospheric pressure by an increase of engine load. Thus, in a case in which determination of engine load is carried out based on intake air pressure PB, it can be assumed that internal combustion engine 101 is rotated forward in a case in which intake air pressure PB is higher than atmospheric pressure by a predetermined degree or more.

In step S502, when it is determined that the current operating conditions of internal combustion engine 101 are conditions for forward rotation of crankshaft 120, the process proceeds to step S503, and "1" is set in a flag F1 representing a history of forward rotation determination based on the operating state of internal combustion engine 101.

Flag F1 is reset to 0 when stop of internal combustion engine 101 is determined, or at the time of restart of internal combustion engine 101. In a case in which "1" is set in flag F1, this means that operating conditions for forward rotation of internal combustion engine 101 have been experienced.

After "1" is set in flag F1 in step S503, or in a case in which it is determined in step S502 that internal combustion engine 101 does not satisfy preset conditions as operating conditions for forward rotation of internal combustion engine 101, the process proceeds to step S504.

In step S504, it is determined whether or not a stop request of internal combustion engine 101 is generated, or whether or not rotating speed of internal combustion engine 101 is lower than idle rotating speed and is lowered for stop.

In other words, in step S504, it is determined whether or not conditions immediately before stop, in which reverse rotation of internal combustion engine 101 can be generated, are satisfied.

Examples of the stop request of internal combustion engine 101 are a driver's stop operation by a key switch and a stop instruction by idle reduction control.

In a case in which it is determined in step S504 that no stop request of internal combustion engine 101 is generated, and that rotating speed of internal combustion engine 101 is not lowered for stop, that is, in a case in which internal combustion engine 101 is in a continuously operated state, determination of reverse rotation is not necessary, and thus the routine ends.

On the other hand, in a case in which it is determined in step S504 that a stop request of internal combustion engine 101 is generated, or that rotating speed of internal combustion engine 101 is lowered for stop, the process proceeds to step S505 and subsequent steps in order to determine whether or not reverse rotation occurs and detect a stop position of crankshaft 120.

In step S505, it is determined whether or not "1" is set in flag F1.

In a case in which flag F1 is "1," this means that operating conditions for forward rotation of crankshaft 120 are present, and it can be assumed that crankshaft 120 is rotated forward in an initial stage of determination of a rotating direction.

On the other hand, in a case in which flag F1 is zero, this means that operating conditions for forward rotation of crankshaft 120 are not experienced, and a current rotating direction may not be a forward rotating direction.

As described later, in determination of a rotating direction based on pulse width WIPOS of rotation signal POS, switching of the rotating direction is detected based on a stepwise change of pulse width WIPOS. Thus, the rotating direction cannot be specified until the stepwise change of pulse width WIPOS is detected.

Accordingly, in a case in which internal combustion engine 101 is operated under conditions for forward rotation of crankshaft 120, it is assumed that the rotating direction at this time is a forward rotating direction, and switching from the forward rotating state to a reverse rotating state is detected based on the stepwise change of pulse width WIPOS.

Consequently, in a case in which there is no history of operation of internal combustion engine 101 under conditions for forward rotation of crankshaft 120, a rotating direction before detection of the stepwise change of pulse width WIPOS is unclear, and a rotating position of crankshaft 120 cannot be detected.

After internal combustion engine 101 is operated under conditions for forward rotation of crankshaft 120, the forward rotating state is normally maintained until immediately before stop of internal combustion engine 101. Thus, flag F1 is set to 1 in a case in which internal combustion engine 101 is operated under conditions for forward rotation of crankshaft 120, and thereafter, flag F1 is still set to 1 even in a case in which conditions for forward rotation of crankshaft 120 are not satisfied any more and is reset to 0 when internal combustion engine 101 is stopped, or at the time of generation of a restart request.

In step S505, in a case in which it is determined that flag F1 is zero, the routine ends to cancel determination of a stop position based on detection of reverse rotation. At the time of restart, detection of a lacking portion of rotation signal POS is started to resume detection of a rotating position of crankshaft 120.

On the other hand, in a case in which flag F1 is "1," the process proceeds to step S506, and it is determined whether or not a flag F2 representing a determination result of a rotating direction is zero. An initial value of flag F2 is 0, which represents forward rotation.

It is to be noted that processing in step S502, step S503, and step S505, that is, processing of determination of whether or not internal combustion engine 101 is operated under conditions for forward rotation of crankshaft 120 and processing of determination of a rotating direction based on the determination result can be omitted, internal combustion engine 101 can be regarded as being rotated forward when a stop request of internal combustion engine 101 is generated, and subsequent switching to reverse rotation can be detected based on a temporal change of pulse width WIPOS.

In an initial stage when the process proceeds to step S504, step S505, and step S506, it is assumed that crankshaft 120 is rotated forward, in correspondence with this, flag F2 is zero as an initial value, and thus the process proceeds from step S506 to step S507.

In step S507, a difference ΔWIPOS between a pulse width WIPOSnew measured at present and a pulse width WIPO- Sold of previous rotation signal POS measured at the time of previous execution of the routine (ΔWIPOS=WIPOSnew−WIPOSold) is calculated, and it is determined whether or not this difference ΔWIPOS is greater than a first threshold value SL1 (SL1>0).

In other words, in step S507, whether or not pulse width WIPOSnew of present rotation signal POS exceeds first threshold value SL1 and is greater than pulse width WIPOSold of previous rotation signal POS, that is, whether or not pulse width WIPOS is increased from the previous time to the present time based on a temporal difference between data of pulse widths WIPOS is determined.

Aforementioned first threshold value SL1 and an aftermentioned second threshold value SL2 are values calculated based on experiments and simulations in advance and stored in a memory so that a stepwise changing state of pulse width WIPOS by switching of a rotating direction and an almost-no-changing state of pulse width WIPOS caused by maintaining of a fixed rotating direction can be distinguished.

As described above, since pulse width WIPOS of rotation signal POS is set to be wider at the time of reverse rotation than at the time of forward rotation, pulse width WIPOS changes to increase in a stepwise manner when a rotating direction of crankshaft 120 is switched from forward rotation to reverse rotation. On the other hand, pulse width WIPOS maintains a fixed value while crankshaft 120 continues to be rotated in a forward rotating direction.

Thus, in a case in which it is determined at step S507 that ΔWIPOS≤ (less than or equal to) first threshold value SL1, that is, in a case in which a stepwise increase change of pulse width WIPOS is not detected and pulse width WIPOS maintains an approximately fixed value, it is determined that crankshaft 120 continues to be rotated in a forward rotating direction, and the process proceeds to step S508. In step S508, forward rotation of crankshaft 120 is determined, and in step S509, flag F2 remains zero.

In a case in which it is determined at step S507 that ΔWIPOS> (greater than) first threshold value SL1, this means that pulse width WIPOS has changed to increase in a stepwise manner from the previous time to the present time, and the increase change of pulse width WIPOS indicates that a rotating direction of crankshaft 120 has been switched from forward rotation to reverse rotation.

When it is determined that ΔWIPOS> (greater than) first threshold value SL1, the process proceeds to step S510, and it is determined that a rotating direction of crankshaft 120 is a reverse rotating direction. In subsequent step S511, "1" is set in flag F2, representing a reverse rotating state.

When a rotating direction of crankshaft 120 is switched from forward rotation to reverse rotation, and thus "1" is set in flag F2, it is determined in step S506 in a subsequent routine that flag F2 is "1," and the process proceeds to step S512.

In a case in which crankshaft 120 is rotated in a reverse direction, switching of a rotating direction to be generated subsequently is switching from reverse rotation to forward rotation, and at the time of such switching of a rotating direction, pulse width WIPOS of rotation signal POS decreases in a temporal manner.

Thus, in step S512, it is determined whether or not ΔWIPOS< (less than) second threshold value SL2 (SL2<0) to determine whether or not pulse width WIPOS has changed to decrease in a stepwise manner from the previous time to the present time.

In a case in which a state in which crankshaft 120 is rotated in a reverse direction is maintained, pulse width WIPOS does not decrease in a stepwise manner but is maintained approximately constant. Thus, in step S512, it is determined that ΔWIPOS≥ (greater than or equal to) second threshold value SL2.

When ΔWIPOS≥ (greater than or equal to) second threshold value SL2, the process proceeds to step S510 to still determine a reverse rotating state, and in subsequent step S511, flag F2 remains "1."

On the other hand, in a case in which it is determined at step S512 that ΔWIPOS< (less than) second threshold value SL2, it is determined that a rotating direction of crankshaft 120 has been switched from reverse rotation to forward rotation, and the process proceeds to step S508.

In step S508, it is determined that a rotating direction of crankshaft 120 is a forward rotating direction. In subsequent step S509, zero is set in flag F2, representing a forward rotating state.

In determination of a rotating direction of crankshaft 120 in the above manner, at the time of forward rotation, it is determined that crankshaft 120 is rotated in a forward direction at the time of output of rotation signal POS as much as a crank angle corresponding to a generating interval of rotation signals POS, from the position at the previous time.

On the other hand, at the time of reverse rotation of crankshaft 120, it is determined that crankshaft 120 is rotated in a reverse direction at the time of output of rotation signal POS as much as a crank angle corresponding to a generating interval of rotation signals POS from the position at the previous time.

In this manner, ECU 114 determines an angle position of crankshaft 120 at every generation of rotation signal POS and updates a detection result of an angle position of crankshaft 120 until stop of rotation of internal combustion engine 101 to detect a stop position of crankshaft 120. ECU 114 then determines timing of fuel injection and ignition based on the stop position of crankshaft 120 at the time of restart of internal combustion engine 101.

FIG. 4 is a timing chart illustrating an example of correlation among pulse width WIPOS, difference ΔWIPOS, and a determination result of a rotating direction.

From a first pulse #1 to a third pulse #3 of rotation signal POS, pulse width WIPOS=45 μs corresponding to a width at the time of forward rotation is maintained, and difference ΔWIPOS remains around 0, representing that the present value and the previous value are approximately equal, in correspondence with forward rotation of crankshaft 120.

Subsequently, during a period from generation of third pulse #3 to generation of a subsequent fourth pulse #4, a rotating direction of crankshaft 120 is switched from forward rotation to reverse rotation, and pulse width WIPOS of fourth pulse #4 is around 90 μs.

Here, difference ΔWIPOS calculated in a case in which fourth pulse #4 is present rotation signal POS and third pulse #3 is previous rotation signal POS, is changed to be greater than first threshold value SL1 by a difference in a rotating direction when each pulse is generated, and switching from forward rotation to reverse rotation is detected.

When a fifth pulse #5 is generated, a reverse rotating state is still maintained, and thus pulse width WIPOS of fifth pulse #5 is around 90 μs. As a result, difference ΔWIPOS between pulse width WIPOS of fourth pulse #4 and pulse width WIPOS of fifth pulse #5 is around 0, which indicates that a reverse rotating state is maintained.

Subsequently, during a period from generation of fifth pulse #5 to generation of a subsequent sixth pulse #6, a rotating direction of crankshaft 120 is switched from reverse rotation to forward rotation, and pulse width WIPOS of sixth pulse #6 is around 45 μs.

Here, difference ΔWIPOS calculated in a case in which sixth pulse #6 is present rotation signal POS and fifth pulse #5 is previous rotation signal POS, is changed to be less than second threshold value SL2 by a difference in a rotating direction when each pulse is generated, and switching from reverse rotation to forward rotation is detected.

In the above manner, pulse width WIPOS of rotation signal POS is made to differ depending on a rotating direction of crankshaft 120, and switching of a rotating direction is determined based on a temporal change of pulse width WIPOS of rotation signal POS, that is, difference ΔWIPOS between present pulse width WIPOS and previous pulse width WIPOS.

Accordingly, even when pulse widths WIPOS to be measured vary due to an environmental change such as a temperature, it is possible to accurately determine a rotating direction.

That is, variation of measurement values of pulse widths WIPOS due to an environmental change such as temperature is generated irrespective of rotating directions. For example, in a case in which a measurement value of pulse width WIPOS at the time of forward rotation increases due to an environmental change, a measurement value of pulse width WIPOS at the time of reverse rotation also increases. Variation of pulse widths WIPOS due to an environmental change does not have a significant influence on difference ΔWIPOS.

Accordingly, by determining switching of a rotating direction based on difference ΔWIPOS representing a temporal change of pulse width WIPOS, even when measured pulse widths WIPOS vary due to a change in an environmental condition such as a temperature, it is possible to accurately determine a rotating direction of crankshaft 120.

Conversely, in a case in which it is determined whether pulse width WIPOS is pulse width WIPOS at the time of forward rotation or pulse width WIPOS at the time of reverse rotation by determining whether pulse width WIPOS is greater or less than a threshold value, it is difficult to set a threshold value that can deal with measurement variation of pulse widths WIPOS due to an environmental change. Also, even in a case in which a threshold value is learned with reference to pulse width WIPOS measured under operating conditions for forward rotation of crankshaft 120, determination accuracy of a rotating direction is lowered when an environmental condition when the threshold value has been learned differs from an environmental condition when a rotating direction is determined based on the threshold value.

It is to be noted that difference ΔWIPOS representing a temporal change of pulse width WIPOS of rotation signal POS may be ΔWIPOS=WIPOSold−WIPOSnew. In a case in which ΔWIPOS=WIPOSold−WIPOSnew, switching from forward rotation to reverse rotation is determined when difference ΔWIPOS is changed from around 0 to a negative value, whereas switching from reverse rotation to forward rotation is determined when difference ΔWIPOS is changed from around 0 to a positive value.

Also, as a value representing a temporal change of pulse width WIPOS of rotation signal POS, a ratio RPOS between present pulse width WIPOSnew and previous pulse width WIPOSold can be calculated.

In this case, in a case in which ratio RPOS=WIPOSnew/WIPOSold, for example, switching from forward rotation to reverse rotation is determined when ratio RPOS is greater than a first threshold value RSL1 (RSL1>1), whereas switching from reverse rotation to forward rotation is determined when ratio RPOS is less than a second threshold value RSL2 (RSL2<1).

Also, in a case in which ratio RPOS=WIPOSold/WIPOSnew, for example, switching from reverse rotation to forward rotation is determined when ratio RPOS is greater than first threshold value RSL1 (RSL1>1), whereas switching from forward rotation to reverse rotation is determined when ratio RPOS is less than second threshold value RSL2 (RSL2<1).

On the other hand, when ratio RPOS is a value around 1, it is determined that a previous rotating direction is maintained.

As described above, in a case of using ratio RPOS as a value representing a temporal change of pulse width WIPOS of rotation signal POS, it is possible to accurately determine a rotating direction, even when measurement variation of pulse widths WIPOS is generated due to an environmental change such as a temperature in a similar manner to that in a case of using difference ΔWIPOS.

Also, rotation signal POS output by crank angle sensor 117 may be a pulse signal having different amplitude (voltage level) depending on a rotating direction of crankshaft 120 instead of a pulse signal having different pulse width WIPOS depending on the rotating direction.

Figure 6:
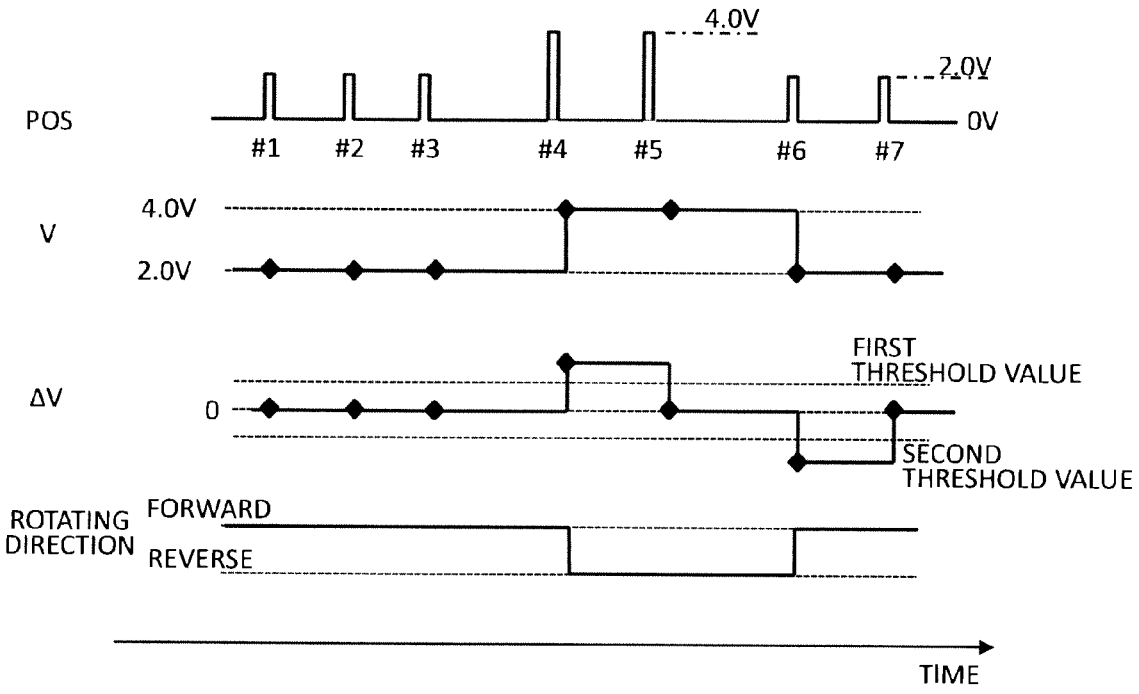
FIG. 6 is a timing chart illustrating correlation among rotation signal POS, amplitude, a change amount of voltage, and the rotating direction according to the embodiment of the present invention.

A timing chart in FIG. 6 illustrates correlation among rotation signal POS, amplitude, a change amount of amplitude, and a rotating direction in processing of determining a rotating direction of crankshaft 120 based on rotation signal POS having different amplitude depending on a rotating direction.

In an example illustrated in FIG. 6, an output characteristic of crank angle sensor 117 is set so that amplitude of rotation signal POS is greater at the time of reverse rotation than at the time of forward rotation.

ECU 114 measures a voltage level (peak voltage) V of rotation signal POS and calculates a difference V between a present voltage level Vnew and a previous voltage level Vold (V=Vnew−Vold) in a similar manner to that in determination of a rotating direction based on pulse width WIPOS.

When difference ΔV is greater than a first threshold value VSL1 (VSL1>0), that is, when difference ΔV is changed from around 0 to a positive value, switching from forward rotation to reverse rotation is determined. On the other hand, when difference ΔV is less than a second threshold value VSL2 (VSL2<0), that is, when difference ΔV is changed from around 0 to a negative value, switching from reverse rotation to forward rotation is determined.

It is to be noted that difference ΔV may be ΔV=Vold−Vnew. Also, instead of difference ΔV, a ratio RV between present voltage level Vnew and previous voltage level Vold can be calculated as ratio RV=Vold/Vnew or ratio RV=Vnew/Vold, and it is possible to determine a rotating direction by comparing this ratio RV with a threshold value.

Also, it is possible to set a characteristic of crank angle sensor 117 so that amplitude may be less at the time of reverse rotation than at the time of forward rotation.

As described above, in a case of determining a rotating direction based on a temporal change of amplitude of rotation signal POS, it is possible to accurately determine a rotating direction even when measurement variation of amplitude (voltage levels) is generated due to an environmental change such as temperature in a similar manner to that in a case of determining a rotating direction based on a temporal change of pulse width WIPOS.

Also, in determination of a temporal change of a pulse width or amplitude of rotation signal POS, instead of comparison between a present value and a previous value, an average value of plural past measurement values of signals of which rotating directions are determined to be equal and a present measurement value can be compared. As the average value of measurement values, a weighted average value, a simple average value, an average value of data excluding a maximum value and a minimum value, or the like can be used.

Also, to determine a rotating direction, measurement values can be compared in a longer interval than a measurement cycle such as comparison between a present measurement value and a value before a previous measurement value.

Also, processing of comparing a measurement value of a pulse width or amplitude of rotation signal POS with a threshold value and determining a rotating direction of crankshaft 120 and processing of determining a rotating direction of crankshaft 120 based on a temporal change of a measurement value of a pulse width or amplitude of rotation signal POS can be used in combination.

For example, a measurement value of a pulse width or amplitude of rotation signal POS and a threshold value thereof can be compared to determine a rotating direction in a case in which a difference between the measurement value of the pulse width or amplitude and the threshold value is greater than a setting value, and it is assumed that determination accuracy can be secured, and a rotating direction can be determined based on a temporal change of a measurement value of a pulse width or amplitude in a case in which the difference is less than the setting value, and it is assumed that determination accuracy is lowered.

Also, based on an average value of plural past measurement values of signals of rotating directions are determined to be equal, a threshold value of a difference or a ratio can be learned.

Also, in a case in which a measurement value of a pulse width or amplitude or a difference or a ratio of the measurement value is out of a predetermined range, determination of a rotating direction based on the data can be prohibited. In a case in which determination of a rotating direction is prohibited, that is, in a case in which a stop position cannot be detected, idle reduction control can be prohibited.

Also, although rotation signal POS in the present embodiment is used both for detection of a rotating position of crankshaft 120 and for detection of a rotating direction of crankshaft 120, a sensor adapted to output a pulse signal for use in detection of a rotating position of crankshaft 120 and a sensor for use in detection of a rotating direction of crankshaft 120 can be provided separately.

The entire contents of Japanese Patent Application NO. 2012-061368, filed Mar. 19, 2012, are incorporated herein by reference.

While only a select embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention are provided for illustration only, and not for the purpose of limiting the invention, the invention as claimed in the appended claims and their equivalents.

What is claimed is:

1. An apparatus for controlling an internal combustion engine including a rotating sensor which outputs a rotation signal having a waveform that is different depending on whether an output shaft of the engine is rotated forward or in reverse, and a fuel injection valve for injecting fuel to the internal combustion engine, comprising:

a control unit comprising a processor and a memory having programmed instructions stored thereon, which when executed by the processor, cause the control unit to receive the rotation signal and output an operation signal to the fuel injection valve;

measure a waveform of the rotation signal;

calculate a difference between a rotational signal value which is currently measured and a rotational signal value which is previously measured detect a changeover from forward rotation to reverse rotation when a difference calculated by the control unit exceeds a first threshold value for detection of the changeover from forward rotation to reverse rotation;

detect a changeover from reverse rotation to forward rotation when a difference calculated by the control unit exceeds a second threshold value for detection of the changeover from reverse rotation to forward rotation;

detect an angular position of the output shaft during stop of the internal combustion engine, based on a detection result of rotation by the control unit; and control fuel injection timing by the fuel injection valve when the internal combustion engine is restarted, based on the angular position of the output shaft.

2. The apparatus for controlling an internal combustion engine according to claim 1, wherein the rotation signal has a different pulse width depending on whether the output shaft is rotated forward or in reverse.

3. The apparatus for controlling an internal combustion engine according to claim 1, wherein the rotation signal has a different amplitude depending on whether the output shaft is rotated forward or in reverse.

4. The apparatus for controlling an internal combustion engine according to claim 1, wherein the control unit is programmed to determine a rotating direction of the output shaft based on a difference between temporal data of measurement values of the waveform.

5. The apparatus for controlling an internal combustion engine according to claim 1, wherein the control unit is programmed to determine a rotating direction of the output shaft based on a ratio between temporal data of measurement values of the waveform.

6. The apparatus for controlling an internal combustion engine according to claim 1, wherein the control unit is programmed to determine a rotating direction of the output shaft based on a change in the waveform after the control unit determines that operating conditions for forward rotation of the output shaft are present.

7. The apparatus for controlling an internal combustion engine according to claim 1, wherein at least one of the changeover from reverse rotation to forward rotation or the changeover from forward rotation to reverse rotation corresponds to switching of a rotating direction of the output shaft when the waveform is changed to exceed a threshold value.

8. The apparatus for controlling an internal combustion engine according to claim 1, wherein the control unit is programmed to determine a rotating direction of the output shaft based on a change in the waveform when a stop request of the internal combustion engine is generated.

9. The apparatus for controlling an internal combustion engine according to claim 1, wherein the control unit is programmed to determine a rotating direction of the output shaft based on the change in the waveform when a rotating speed of the internal combustion engine is lowered to stop the engine.

10. The apparatus for controlling an internal combustion engine according to claim 1, wherein the control unit is programmed to determine a rotating direction of the output shaft based on a change in the waveform after a rotating speed of the internal combustion engine exceeds a predetermined speed.

11. The apparatus for controlling an internal combustion engine according to claim 1, wherein the control unit is programmed to determine a rotating direction of the output shaft based on a change in the waveform after a load of the internal combustion engine exceeds a predetermined value.

12. The apparatus for controlling an internal combustion engine according to claim 1, wherein the control unit is programmed to determine a rotating direction of the output shaft based on a change in the waveform after detecting that a cylinder of which a piston is in a predetermined position is switched along a forward rotating direction.

13. The apparatus for controlling an internal combustion engine according to claim 1, wherein the control unit is programmed to determine a rotating direction of the output shaft based on a change in the waveform after the internal combustion engine is started by a starter motor.

14. The apparatus for controlling an internal combustion engine according to claim 1, wherein the control unit is programmed to determine a rotating direction of the output shaft based on a change in the waveform after intake air pressure of the internal combustion engine exceeds atmospheric pressure by a predetermined value.

15. An apparatus for controlling an internal combustion engine including a rotating sensor outputting a rotation signal having a waveform that is different depending on whether an output shaft of the engine is rotated forward or in reverse, and a fuel injection valve for injecting fuel to the internal combustion engine, comprising:

a control means for receiving the rotation signal and outputting an operation signal to the fuel injection valve, the control means including a measuring means for measuring a waveform of the rotation signal;

an operation means for calculating a difference between a rotational signal value currently measured by the measuring means and a rotational signal value previously measured by the measuring means;

a first detecting means for detecting a changeover from forward rotation to reverse rotation when the difference calculated by the operation means exceeds a first threshold value for detection of the changeover from forward rotation to reverse rotation;

a second detecting means for detecting a changeover from reverse rotation to forward rotation when the difference calculated by the operation means exceeds a second threshold value for detection of the changeover from reverse rotation to forward rotation;

a third detecting means for detecting an angular position of the output shaft during stop of the internal combustion engine, based on a detection result of rotation by the first detecting means and the second detecting means; and an injection control means for controlling fuel injection timing by the fuel injection valve when the internal combustion engine is restarted, based on the angular position of the output shaft detected by the third detecting means.

16. A method for controlling an internal combustion engine including a rotating sensor outputting a rotation signal having a waveform that is different depending on whether an output shaft of the engine is rotated forward or in reverse, and a fuel injection valve for injecting fuel to the internal combustion engine, comprising:

receiving, by a control unit, the rotation signal and outputting, by the control unit, an operation signal to the fuel injection valve, the control unit performing:

measuring a waveform of the rotation signal;

calculating a difference between a rotational signal value currently measured by the control unit and a rotational signal value previously measured by the control unit;

detecting a changeover from forward rotation to reverse rotation when the difference calculated by the control unit exceeds a first threshold value for detection of the changeover from forward rotation to reverse rotation;

detecting a changeover from reverse rotation to forward rotation when the difference calculated by the control unit exceeds a second threshold value for detection of the changeover from reverse rotation to forward rotation;

detecting an angular position of the output shaft during stop of the internal combustion engine, based on a detection result of rotation by the control unit; and controlling fuel injection timing by the fuel injection valve when the internal combustion engine is restarted, based on the angular position of the output shaft detected by the control unit.

17. The method of controlling an internal combustion engine according to claim 16, further comprising:

detecting whether or not operating conditions for forward rotation of the output shaft are satisfied; and after detecting that the operating conditions for forward rotation of the output shaft are satisfied, detecting a rotating direction of the output shaft.

18. The method of controlling an internal combustion engine according to claim 16, wherein at least one of the changeover from reverse rotation to forward rotation or the changeover from forward rotation to reverse rotation corresponds to switching a rotating direction of the output shaft when the waveform is changed to exceed a threshold value.

19. The method of controlling an internal combustion engine according to claim 16, further comprising:

detecting whether or not a stop request of the internal combustion engine is generated; and when the stop request of the internal combustion engine is generated, detecting a rotating direction of the output shaft.

20. The method of controlling an internal combustion engine according to claim 16, further comprising:

detecting whether or not a rotating speed of the internal combustion engine is lowered to stop the engine; and when the rotating speed of the internal combustion engine is lowered to stop the engine, detecting a rotating direction of the output shaft.

* * * * *